US006629414B2

(12) United States Patent
Fischer

(10) Patent No.: US 6,629,414 B2
(45) Date of Patent: Oct. 7, 2003

(54) ULTRA LOW $NO_X$ EMISSIONS COMBUSTION SYSTEM FOR GAS TURBINE ENGINES

(75) Inventor: Bernard Fischer, Toronto (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 10/349,243

(22) Filed: Jan. 23, 2003

(65) Prior Publication Data

US 2003/0131598 A1 Jul. 17, 2003

Related U.S. Application Data

(62) Division of application No. 09/843,753, filed on Apr. 30, 2001, now Pat. No. 6,532,743.

(51) Int. Cl.[7] ..... F23R 3/40
(52) U.S. Cl. ..... 60/723
(58) Field of Search ..... 60/723, 777; 431/7, 431/170

(56) References Cited

U.S. PATENT DOCUMENTS

| | | | | |
|---|---|---|---|---|
| 2,655,786 | A | | 10/1953 | Carr |
| 2,696,076 | A | | 12/1954 | Weeks |
| 3,797,231 | A | | 3/1974 | McLean |
| 3,928,961 | A | | 12/1975 | Pfefferle |
| 3,975,900 | A | | 8/1976 | Pfefferle |
| 4,019,316 | A | | 4/1977 | Pfefferle |
| 4,040,252 | A | | 8/1977 | Mosier et al. |
| 4,065,917 | A | | 1/1978 | Pfefferle |
| 4,433,540 | A | | 2/1984 | Cornelius et al. |
| 5,161,366 | A | | 11/1992 | Beebe |
| 5,412,938 | A | | 5/1995 | Keller |
| 5,431,017 | A | | 7/1995 | Kobayashi et al. |
| 5,452,574 | A | | 9/1995 | Cowell et al. |
| 5,531,066 | A | | 7/1996 | Pfefferle et al. |
| 5,569,020 | A | | 10/1996 | Griffin et al. |
| 5,623,819 | A | | 4/1997 | Bowker et al. |
| 5,685,156 | A | | 11/1997 | Willis et al. |
| 5,826,429 | A | | 10/1998 | Beebe et al. |
| 5,850,731 | A | | 12/1998 | Beebe et al. |
| 5,937,632 | A | | 8/1999 | Döbbeling et al. |
| 6,105,360 | A | | 8/2000 | Willis |
| 6,125,625 | A | * | 10/2000 | Lipinski et al. ..... 60/723 |
| 6,223,537 | B1 | * | 5/2001 | Lipinski et al. ..... 60/723 |
| 6,339,925 | B1 | | 1/2002 | Hung et al. |
| 6,442,939 | B1 | | 9/2002 | Stuttaford et al. |

* cited by examiner

*Primary Examiner*—Louis J. Casaregola
(74) *Attorney, Agent, or Firm*—Wayne H. Yan; Ogilvy Renault (PWC)

(57) ABSTRACT

A combustion system for a gas turbine engine includes a Catalyst (CAT) combustion sub-system for generating combustion products under a lean premixed fuel/air condition in the presence of a Catalyst and a Dry-Low-Emissions (DLE) combustion sub-system, for generating combustion products under a lean premixed fuel/air condition. Gaseous and liquid fuels are used for the DLE combustion sub-system while only gaseous fuel is used for the CAT combustion system. The engine operates at start-up and under low load conditions with the DLE combustion system and switches over the combustion process to the CAT combustion sub-system under high load conditions. Thus the combustion system according to the invention combines the advantages of DLE and CAT combustion processes so that the gas turbine engine operates over an entire operating range thereof at high engine efficiency while minimizing emissions of nitrogen oxides and carbon monoxide from the engine.

7 Claims, 3 Drawing Sheets

ULTRA LOW $NO_x$ EMISSIONS COMBUSTION SYSTEM FOR GAS TURBINE ENGINES

CROSS-REFERENCED TO RELATED APPLICATIONS

This application is a divisional of U.S. patent application Ser. No. 09/843,753 filed Apr. 30, 2001, and was allowed on Nov. 28, 2002. U.S. Pat. No. 6,532,743

FIELD OF THE INVENTION

The present invention relates to gas turbine engines, and more particularly, to an ultra low $NO_x$ emissions combustion system for gas turbine engines.

BACKGROUND OF THE INVENTION

Low $NO_x$, emissions from a gas turbine engine, of below 10 volume parts per million (ppmv), are becoming important criteria in the selection of gas turbine engines for power plant applications. Some installations in non-attainment area in the United States are demanding even lower $NO_x$ emissions of less than 5 ppmv. The challenging $NO_x$ emission requirements must be achieved without compromising the more conventional constraints on gas turbine engines, of durability, low operating costs and high efficiency.

The main factor governing nitrogen oxide formation is temperature. One of the most attractive methods of reducing flame temperatures involves using Lean Premixed combustion, in which reductions in flame temperatures are readily accomplished by increasing the air content in a given fuel/air mixture. This method is often referred to as a Dry-Low-Emissions (DLE) to distinguish it from Wet $NO_x$ control by water or steam injection, and highlight the low emissions in which $NO_x$, levels down to 10 ppmv can be achieved.

However, flame stability decreases rapidly under these lean combustion conditions and the combustor may be operating close to its blow-out limit. In addition, severe constraints are imposed on the homogeneity of the fuel/air mixture since leaner than average pockets of mixture may lead to stability problems and richer than average pockets will lead to unacceptably high $NO_x$, emissions. The emission of carbon monoxide as a tracer for combustion efficiency will increase at leaner mixtures for a given combustor due to the exponential decrease in chemical reaction kinetics. Engine reliability and durability are of major concern under lean combustion conditions due to high-pressure fluctuations enforced by flame instabilities in the combustor.

It is well known in the industry that catalytic combustion can be used as an ultra-lean premixed combustion process where a catalyst is used to initiate and promote chemical reactions in a premixed fuel/air mixture beyond flammability limits that would otherwise not burn. This permits a reduction of peak combustion temperatures to levels below 1,650K, and $NO_x$ emissions less than 5 ppmv can be achieved.

Nevertheless, major challenges have prevented the implementation of catalytic combustors in a gas turbine engine. Catalyst operation and durability demand a very tight control over the engine and catalyst inlet operating parameters. As shown in FIG. 1, which is a graphical representation of a normalized catalyst operating window and the compressor discharge temperature variations from engine idle to full power, the compressor discharge temperatures increase from engine idle to full power over a range typically more than three times that which, as being defined between lines M and N, is acceptable for catalyst operation.

In the prior art, most Catalyst combustion systems utilize a pre-burner to increase compressor discharge air temperature at engine low power conditions where the compressor discharge air temperature is below catalyst ignition temperature. Other major problems in catalyst operation include ignition, engine start-up and catalyst warm-up which cannot be performed with the catalyst. A separate fuel system is required. Any liquid fuel combustion has to be introduced downstream of the catalyst to prevent liquid fuel flooding the catalyst in case of ignition failure. Because of the narrow range of acceptable catalyst inlet temperatures, the catalyst has to be designed for full power operating conditions. As the engine decelerates the fuel/air mass ratio decreases. Generally, this compromises the catalyst and engine performance under part load conditions, thereby resulting in emissions leading to very high $NO_x$, and CO levels. The catalyst durability is affected by engine transient operation since catalyst operation is a delicate balancing act between catalyst ignition (blow-out) and catalyst burn-out. In this sense, turn-down of the catalyst system becomes a serious operability and durability issue. In the case when the pre-burner is used for part load or the entire operating range of the engine, the pre-burner then becomes the main source of $NO_x$, emissions from the engine. In addition, hot streaks from the pre-burner are very likely to damage catalyst hardware directly or act as sources of auto-ignition within the fuel/air mixing duct upstream of the catalyst, and impose a substantial risk to catalyst and engine operation. A pre-burner also substantially increases the combustor pressure drop by an additional 1.5% to 2.5%, which directly affects engine specific fuel consumption.

Efforts have been made to improve catalytic combustors for gas turbine engines. One example of the improvements is described in U.S. Pat. No. 5,623,819, issued to Bowker et al. on Apr. 29, 1997. Bowker et al. describe a low $NO_x$ generating combustor in which a first lean mixture of fuel and air is pre-heated by transferring heat from hot gas discharging from the combustor. The pre-heated first fuel/air mixture is then catalyzed in a catalytic reactor and then combusted so as to produce a hot gas having a temperature in excess of the ignition temperature of the fuel. Second and third lean mixtures of fuel and air are then sequentially introduced into the hot gas, thereby raising their temperatures above the ignition temperature and causing homogeneous combustion of the second and third fuel/air mixtures. This homogeneous combustion is enhanced by the presence of the free radicals created during the catalyzing of the first fuel/air mixture. In addition, the catalytic reactor acts as a pilot that imparts stability to the combustion of the lean second and third fuel/air mixtures.

Another example of the improvements is described in U.S. Pat. No. 5,850,731, issued to Beebe et al. on Dec. 22, 1998. Beebe et al. describe a combustor for gas turbine engines and a method of operating the combustor under low, mid-range and high-load conditions. At the start-up or low-load levels, fuel and compressor discharge air are supplied to the diffusion flame combustion zone to provide combustion products for the turbine. At mid-range operating conditions, the products of combustion from the diffusion flame combustion zone are mixed with additional hydrocarbon fuel for combustion in the presence of a catalyst in the catalytic combustion zone. Because the fuel air mixture in the catalytic reactor bed is lean, the combustion reaction temperature is too low to produce thermal $NO_x$. Under high-load conditions a lean direct injection of fuel/air is provided in a post-catalytic combustion zone where auto-ignition occurs with the reactions going to completion in the transition between the combustor and turbine sections. In the post-catalytic combustion zone, the combustion temperature is low and the residence time in the transition piece is short, hence minimizing thermal $NO_x$.

Nevertheless, there is still a need for further improvements of low emissions combustors for gas turbine engines that will allow minimizing the emissions of the $NO_x$, CO and unburned hydrocarbon (UHC) simultaneously, over the entire operating range of the gas turbine engine.

SUMMARY OF THE INVENTION

It is an object of the present invention to provide an ultra-low emissions combustion system for gas turbine engines which permits minimizing the emissions of $NO_x$, CO and UHC simultaneously over the entire operating range of the gas turbine engine.

It is another object of the present invention to provide a combustor for a gas turbine engine and a method of operating the combustor which combines the advantages of a conventional Dry-low-emissions combustion system with a catalytic combustion system.

It is a further object of the present invention to provide a method for operating a combustor for a gas turbine engine having a conventional Dry-low-emissions combustion system and a Catalyst combustion system which can operate separately, to achieve low emissions of $NO_x$, CO and UHC simultaneously over the entire operating range of the gas turbine engine.

In accordance with one aspect of the present invention, a method of operating a combustor for a gas turbine engine over an entire operating range thereof at high engine efficiency while minimizing emissions of nitrogen oxides $NO_x$, and carbon monoxide CO from the engine, comprises: under low-load conditions supplying a fuel and an air flow to a Dry-low-emissions (DLE) combustion system of the combustor to generate combustion products; under high-load conditions stopping the fuel and air flow to the DLE combustor system and supplying a fuel and air flow to a Catalyst (CAT) combustion system of the combustor to generate combustor products; and the low and high load conditions being defined by a predetermined power level, the predetermined power level being associated with an adequate catalyst inlet temperature so that the combustion procedure of the combustor switches over from the DLE combustor system to the CAT combustor system when the adequate catalyst inlet temperature can be achieved, resulting from increasing of an engine power level.

The catalyst inlet temperature is controlled within catalyst operating conditions for engine loads between the predetermined power level and the full-load condition, preferably by adjusting the air flow to the CAT combustor system and adding heat to the CAT combustor system from the combustor cooling heat transfer. It is preferable to maintain the combustion products from either one of the DLE and CAT combustor systems inside the combustor for an extended residence time in order to convert CO formed in the combustion products to $CO_2$.

In accordance with another aspect of the present invention a low-emissions combustion system for a gas turbine engine is provided. The system comprises a Dry-low-emissions (DLE) combustion sub-system for generating combustion products under a lean premixed fuel/air condition, and a Catalyst (CAT) combustion sub-system for generating combustion products under a lean premixed fuel/air condition in the presence of a catalyst. The combustion system further includes a combustor scroll connected to the DLE and CAT combustion sub-systems for delivering the combustion products in adequate inlet conditions, to an annular turbine of the engine. A fuel injection sub-system for injecting fuel into the respective DLE and CAT combustion sub-systems is provided; and an air supply sub-system for supplying air to the respective DLE and CAT combustion sub-systems is also provided. The combustion system includes a control sub-system for controlling the fuel injection and air supply sub-systems to selectively inject fuel and selectively supply air to the respective DLE and CAT combustion sub-systems.

The combustor scroll preferably includes a transition section connecting the combustor scroll to the DLE and CAT combustion sub-systems. The fuel injection and air supply sub-systems are preferably controlled by the control sub-system to selectively inject the fuel and supply air only to the DLE combustion sub-system when the engine is operated under low load conditions and to selectively inject fuel and supply air only to the CAT combustion sub-system when the engine is operated under high load conditions. The fuel injection sub-system is preferably adapted to selectively inject gaseous and liquid fuel to the DLE combustion sub-system and only inject gaseous fuel to the CAT combustion sub-system.

The separately operated CAT combustion sub-system and the DLE combustion sub-system are preferably integrated into one single combustor can. The CAT combustion sub-system is solely used for the power range from switch-over level to full engine power. No pre-burner is required to increase compressor discharge air temperature for the adequate catalyst inlet temperature under engine part power conditions. The specifically designed and optimized combustor scroll cooling and air bypass permit control of the catalyst inlet temperature within the narrow catalyst operating conditions for engine loads between switch-over and full power load. Below the switch-over load the separate DLE combustion sub-system takes over the combustion process control to ensure highest efficiency, lowest $NO_x$ emissions, and engine operability, ignition and start up. The present invention combines the advantages of the catalytic and more conventional lean-premixed combustion technologies to produce lowest emission levels over the entire engine operating range from idle to full power, for liquid and gaseous hydrocarbon fuels.

Other advantages and features of the present invention will be better understood with reference to a preferred embodiment described hereinafter.

BRIEF DESCRIPTION OF THE DRAWINGS

Having thus generally described the nature of the present invention, reference will now be made to the accompanying drawings, showing by way of illustration a preferred embodiment in which.

DETAILED DESCRIPTION OF THE PREFERRED EMBODIMENTS

Figure 2:
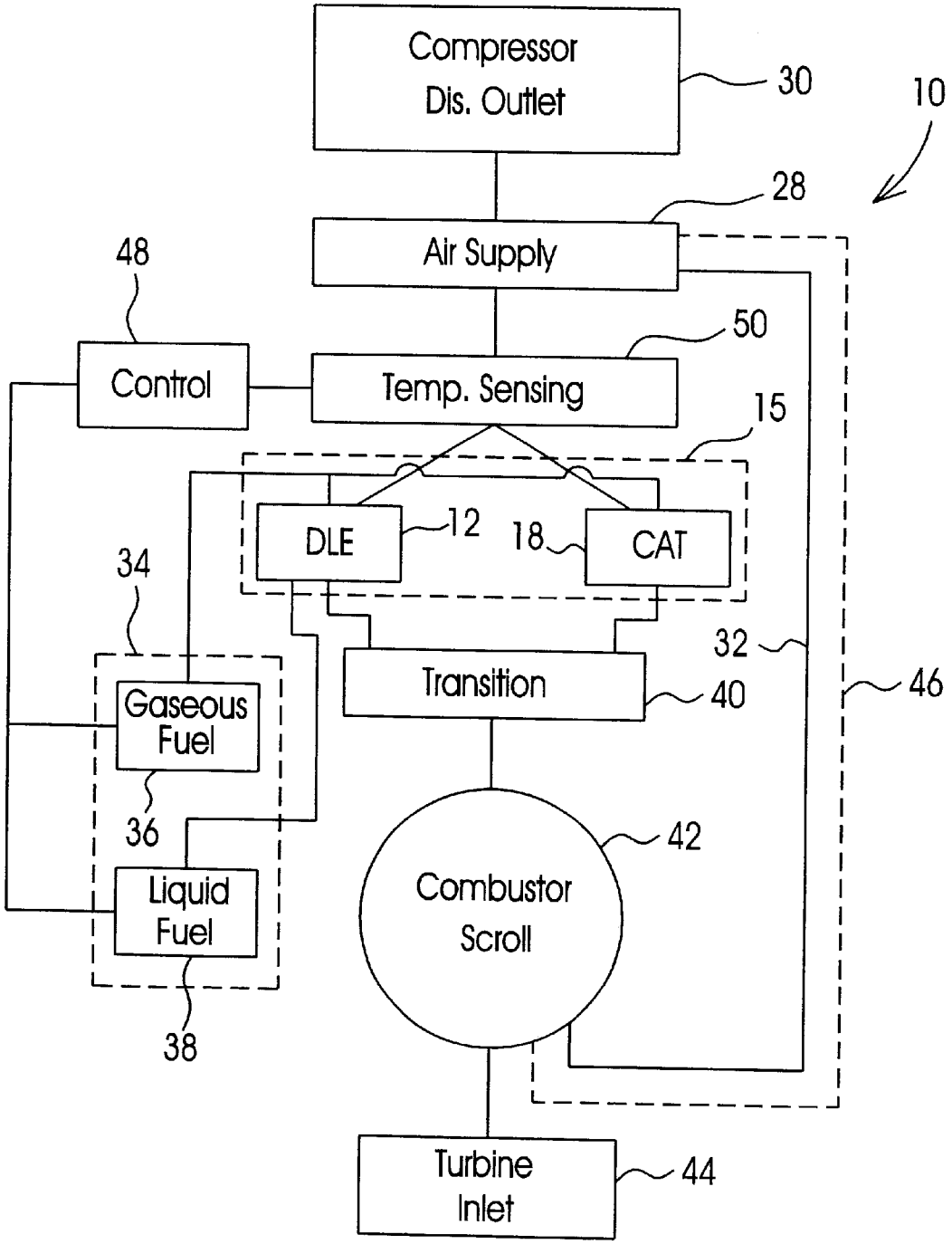
FIG. 2 is a diagram showing a combustion system according to the present invention, into which a DLE combustion sub-system and a CAT combustion sub-system are integrated.
Figure 3:
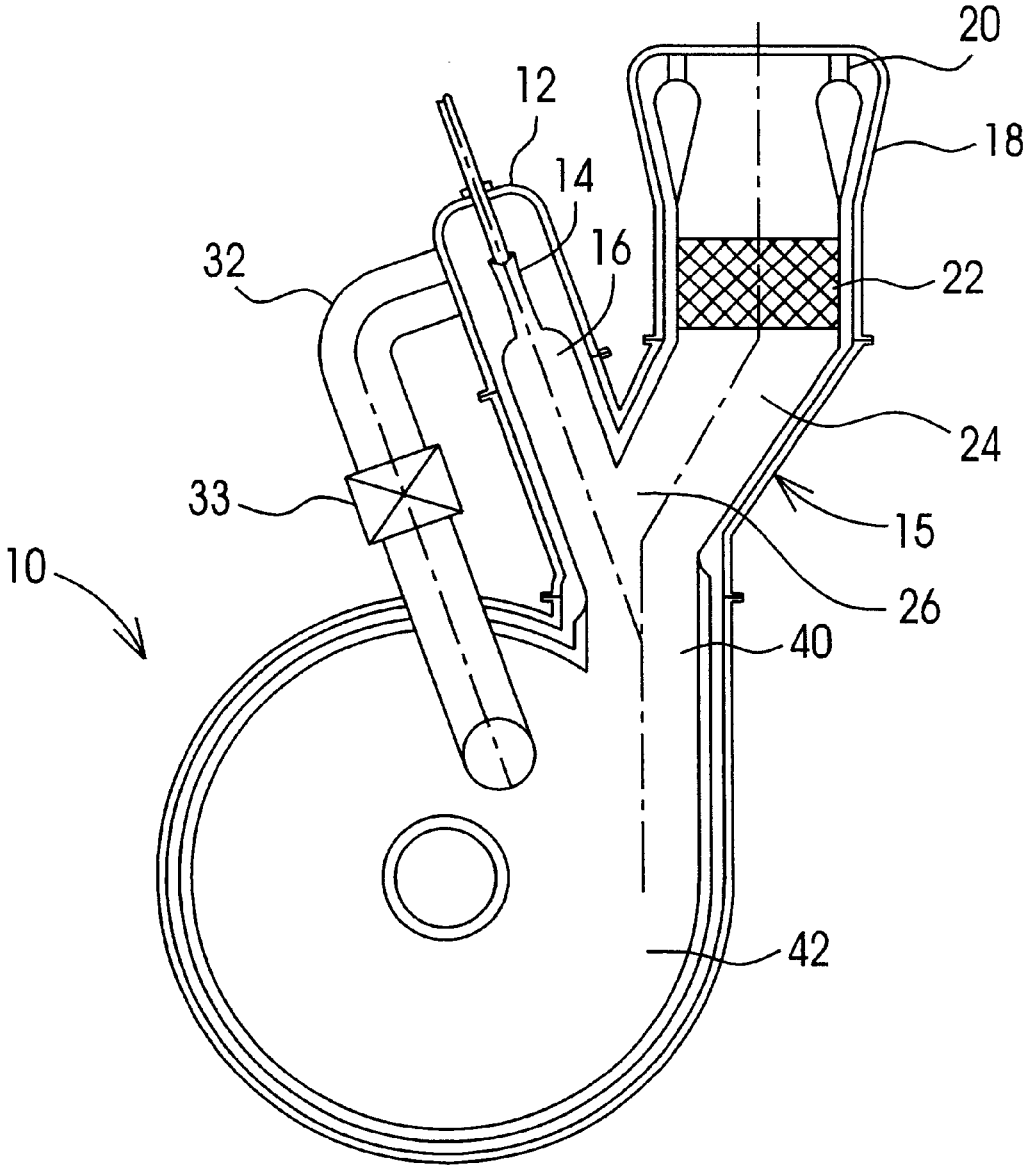
FIG. 3 is a schematic view of a structural arrangement of one embodiment of the present invention.

Referring to the drawings, particularly to FIGS. 2 and 3, the invention describes a combustion system, generally indicated at numeral 10, that permits the operation of a gas turbine engine at highest engine efficiency while minimizing the emissions of nitrogen oxide ($NO_x$,) and carbon monoxide (CO) from the engine. The combustion system 10 includes a Dry-low-emissions (DLE) combustion sub-system 12 which is generally formed with a fuel/air mixer 14 to provide a lean-premixed fuel/air mixture to the burner 16 to generate combustion products, generally hot gas. The DLE combustion sub-system 12 operates on liquid and gaseous hydrocarbon fuels. The DLE combustion sub-system 12 is conventional, well known in the art and will not be further described. A separate Catalyst (CAT) combustion sub-system 18 is included in the combustion system 10 which operates separately from the DLE combustion sub-system 12.

Figure 1:
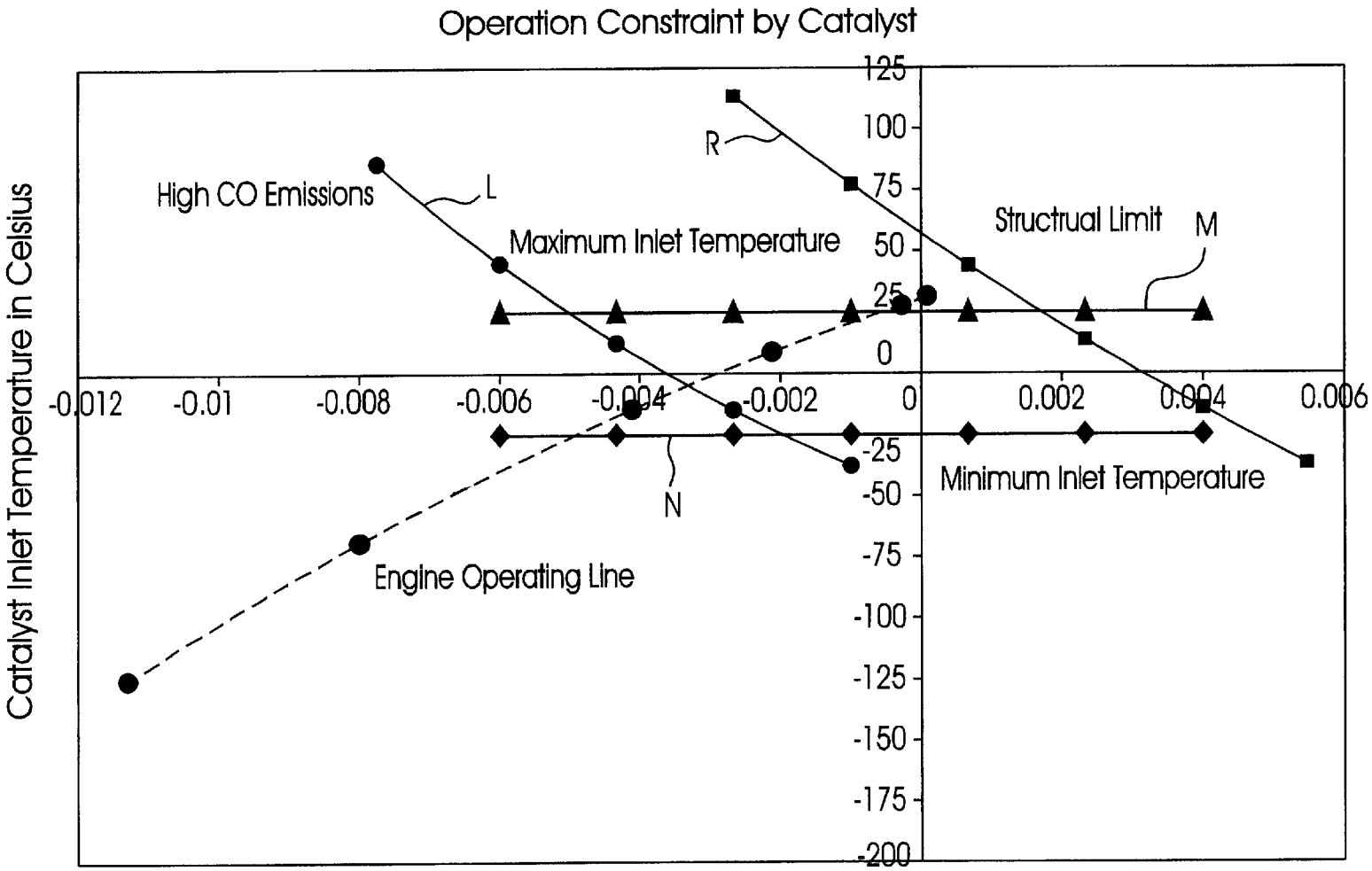
FIG. 1 is a graphical representation showing an operation constraint of a catalytic combustion system, the operation constraint resulting from a narrow window defined by the acceptable maximum and minimum catalyst inlet temperatures and the catalyst inlet fuel/air ratio.

The CAT combustion sub-system 18 includes a fuel/air mixer 20 to provide a lean-premixed fuel/air mixture, a catalyst 22 to initiate chemical reaction and combust approximately 50% of the lean-premixed fuel/air mixture, and a thermal reactor 24 to burn the remainder of the lean-premixed fuel/air mixture into combustion products, generally hot gas. The fuel/air mixer 20 provides a homogeneous mixture of fuel and air at the catalyst 22 inlet. Various means including the use of fuel spokes, air/fuel swirlers, mixing tubes, and other arrangements can achieve this. The catalyst 22 demands a very small deviation in fuel/air mixture variation, from the average. That range of deviation is indicated between the lines L and R as illustrated in FIG. 1. However, it is advantageous to tailor the inlet fuel/air ratio (FAR) from a value of FAR average plus 0.0025 in the center of the catalyst inlet to FAR average minus 0.0025 at the catalyst inlet wall side. It is well understood that every point of the catalyst 22 is operated entirely within the window defined by the maximum inlet temperature, as indicated by line M, and the minimum inlet temperature, as indicated by line N regardless of this being such a small deviation of FAR value.

The DLE and CAT combustion sub-systems are preferably integrated into a single combustion can 15. A CO burn out zone 26 is provided in the joint region of the DLE and the CAT combustion sub-systems 12 and 18 of the combustion can 15 and is sized to ensure enough residence time to convert all CO which is formed under the low temperature combustion resulting from the lean FAR value, to $CO_2$ over the entire range of the combustion operation.

An air supply sub-system 28 is provided to selectively supply air from the compressor discharge outlet 30 to the respective DLE and CAT combustion sub-systems 12 and 18 for the combustion procedure. The air supply sub-system 28 includes a by-pass passage 32 preferably with a valve 33 to permit a portion of compressor discharged air to selectively bypass both the DLE and CAT combustion sub-systems 12 and 18 so that the fuel/air ratio of the mixture entering either DLE combustion sub-system 12 or CAT combustion sub-system 18 becomes independent from the power level during engine operation. This is particularly important to the CAT combustion sub-system 18 because of the narrow operating window of the catalyst 22 inlet conditions as shown in FIG. 1.

A fuel injection sub-system 34 is included in the combustion system 10 and adapted to selectively inject gaseous hydrocarbon fuel 36 into the respective DLE combustion sub-system 12 and the CAT combustion sub-system 18 while selectively injecting liquid hydrocarbon fuel 38 into the DLE combustion sub-system 12.

The DLE and CAT combustion sub-systems 12 and 18 are connected to a transition section 40 of a combustor scroll 42 such that the hot gas resulting from the combustion procedure in the DLE and CAT combustion sub-systems 12 and 18 is delivered through the transition section 40 and the combustor scroll 42 in adequate inlet conditions to the annular turbine inlet 44. Heat exchange means (not shown), such as using convective cooling air, are provided to the combustor scroll 42 to cool the structure of the combustor scroll 42 and the turbine inlet 44. The heat absorbed and carried by the cooling air is transferred back into the air supply sub-system 28 to increase the compressor discharge air temperature and the catalyst 22 inlet temperature, as shown by the dashed line 46 in FIG. 2.

A control sub-system 48 is operatively associated with the air supply sub-system 28, including the valve 33, and the fuel injection sub-system 34. The control sub-system 48 further includes a means 50 for sensing the compressor discharge air temperature so that the control sub-system 48 is adapted to switch over the combustion procedure from the DLE combustion sub-system 12 to the CAT combustion sub-system 18 in response to a temperature signal sent from the temperature sensing means 50.

In operation, the fuel injection sub-system 34 injects gaseous hydrocarbon fuel 36 into the DLE combustion sub-system 12 and the air supply sub-system 28 supplies compressor discharge air to the DLE combustion sub-system 12 for light-off of the combustion procedure and starting up the engine. During the light-off and low power conditions, the control sub-system 48 controls the fuel injection and the air supply, to ensure that an adequate lean-premixed fuel/air mixture is used in the DLE combustion sub-system 12 so that the $NO_x$, CO and UHC components formed in the combustion products are low.

During this period the control sub-system 48 controls the heat addition to the compressor discharge air and the catalyst 22 to increase the compressor discharge air temperature and warm up the catalyst 22. It is optional to switch the fuel supply from gaseous hydrocarbon fuel 36 to liquid hydrocarbon fuel 38, to the DLE combustion sub-system 12 when the engine operation is stable after the idle condition is achieved.

Generally, the compressor discharge air temperature increases as the engine operating power level increases. At a certain power level, an adequate catalyst inlet temperature is reached which falls between the maximum and minimum inlet temperature as illustrated by lines M and N in FIG. 1, and a combustion procedure switch-over takes place. The control sub-system 48 stops the fuel injection and air supply to the DLE combustion sub-system 12, simultaneously beginning to inject gaseous hydrocarbon fuel 36 and supply the compressor discharge air which has an adequate catalyst inlet temperature, to the CAT combustion sub-system 18. The specially designed and optimized combustor scroll cooling and the air bypass, permit control of the catalyst inlet temperature within the narrow catalyst operating conditions for engine loads between the switch-over power level and full load. When the engine operating power level is below the switch-over power level causing the catalyst inlet temperature to decrease beyond the narrow catalyst operating conditions, the DLE combustion sub-system 12 is controlled by the control sub-system 48 to take over the combustion procedure, ensuring highest efficiency, lowest $NO_x$ emissions and engine operability, ignition and start-up.

The combustion system 10 is adapted to selectively use gaseous and liquid hydrocarbon fuel in different engine operating power level ranges. Nevertheless, the DLE combustion sub-system 12 can optionally be used for liquid hydrocarbon fuel from the idle to full load engine operating condition when the combustion system 10 is used in areas requiring different emission levels.

Different structural arrangements and configurations may be designed for the combustion system according to the present invention. Single, dual stage or backup systems for liquid hydrocarbon fuel operation, incorporating different fuel/air mixing system and flame stabilization mechanisms for different emission levels, are also optional to the present invention. It is to be understood that the invention is not limited to the illustrations described and shown herein, which are deemed to be merely illustrative of the best modes of implementation of the invention and which are susceptible to modification of form, size, arrangement of parts, and details of configuration. The invention rather, is intended to encompass all such modifications which are within its spirit and scope as defined by the claims.

I claim:

1. A low-emissions combustion system for a gas turbine engine comprising:

a Dry-Low-Emissions (DLE) combustion sub-system for generating combustion products under a lean premixed fuel/air condition;

a Catalyst (CAT) combustion sub-system for generating combustion products under a lean premixed fuel/air condition in the presence of a catalyst;

a combustor scroll connected to the DLE and CAT combustion sub-systems for delivering the combustion products in adequate inlet conditions to an annular turbine of the engine;

a fuel injection sub-system for injecting fuel into the respective DLE and CAT combustion sub-systems;

an air supply sub-system for supplying air to the respective DLE and CAT combustion sub-systems; and a control sub-system for controlling the fuel injection and air supply sub-systems to selectively inject fuel and selectively supply air to the respective DLE and CAT combustion sub-systems.

2. A low-emissions combustion system as claimed in claim 1 wherein the combustor scroll includes a transition section and is connected through the transition section to both the DLE and CAT combustion sub-systems.

3. A low-emissions combustion system as claimed in claim 1 wherein the fuel injection and air supply sub-systems are controlled to selectively inject fuel and supply air only to the DLE combustion sub-system when the engine is operated under low load conditions, and to selectively inject fuel and supply air only to the CAT combustion sub-system when the engine is operated under high load conditions.

4. A low-emissions combustion system as claimed in claim 1 wherein the control sub-system includes temperature sensing means for measuring compressor discharge air temperature, and is adapted to switch the fuel injection and the air supply from the DLE combustion sub-system to the CAT combustion sub-system when the compressor discharge air temperature reaches a predetermined level to ensure an adequate catalyst inlet temperature.

5. A low-emissions combustion system as claimed in claim 1 wherein the fuel injection sub-system is adapted to selectively inject gaseous and liquid fuel into the DLE combustion sub-system.

6. A low-emissions combustion system as claimed in claim 1 wherein the fuel injection sub-system is adapted to inject gaseous fuel into the CAT combustion sub-system.

7. A low-emissions combustion system as claimed in claim 1 wherein the air supply sub-system includes a by-pass passage for permitting compressor discharge air to controllably by-pass the DLE and CAT combustion sub-systems to ensure that an adequate fuel/air ratio of the fuel/air mixture entering DLE and CAT combustion sub-systems is independent from engine operating conditions.

* * * * *